United States Patent [19]

Hutchison

[11] 4,275,485

[45] Jun. 30, 1981

[54] SEALING DEVICES

[76] Inventor: Charles L. Hutchison, 7855 S. Normandy, Burbank, Ill. 60459

[21] Appl. No.: 101,859

[22] Filed: Dec. 10, 1979

[51] Int. Cl.[3] ..... B65D 77/10

[52] U.S. Cl. ..... 24/30.5 R; 24/30.5 P; 24/255 SL; 229/62

[58] Field of Search ..... 24/30.5 R, 30.5 W, 30.5 P, 24/30.5 S, 30.5 T, 30.5 L, 255 SL; 229/62, 65, 63, 64

[56] References Cited

U.S. PATENT DOCUMENTS

| | | | |
|---|---|---|---|
| 3,086,264 | 4/1963 | Tindall | 229/65 |
| 3,110,070 | 11/1963 | Tremblay | 24/30.5 R |
| 3,266,711 | 8/1966 | Song | 229/62 |
| 3,503,119 | 3/1970 | Seitz, Jr. et al. | 24/30.5 W |
| 3,673,640 | 7/1972 | Brown | 24/30.5 R |
| 3,713,622 | 1/1973 | Dinger | 24/255 SL |
| 3,854,482 | 12/1974 | Laugherty et al. | 24/255 SL |
| 3,906,592 | 9/1975 | Sakasegawa et al. | 24/255 SL |
| 3,935,977 | 2/1976 | Bonnett | 24/255 SL |
| 4,038,726 | 8/1977 | Takabayashi | 24/255 SL |
| 4,128,922 | 12/1978 | Hutchison | 24/30.5 R |

FOREIGN PATENT DOCUMENTS

| | | | |
|---|---|---|---|
| 1326485 | 4/1963 | France | 24/30.5 R |

*Primary Examiner*—Victor N. Sakran

*Attorney, Agent, or Firm*—Neuman, Williams, Anderson & Olson

[57] ABSTRACT

Sealing devices are disclosed in which two members are connected through a hinge for clamping and sealing engagement with gathered-together material at the end of an enclosure. The hinge facilitates installation and accurately aligns interacting parts including a projecting structure on one member with an opening in the other, interengageable locking elements on side portions of the members and sealing elements on end portions of the members. The locking elements include a shoulder on one member engageable by a shoulder on a projection on the other, the projection being engageable in one embodiment for release. Additional locking elements are positioned adjacent the hinge connection for reinforcement.

18 Claims, 9 Drawing Figures

FIG. 1
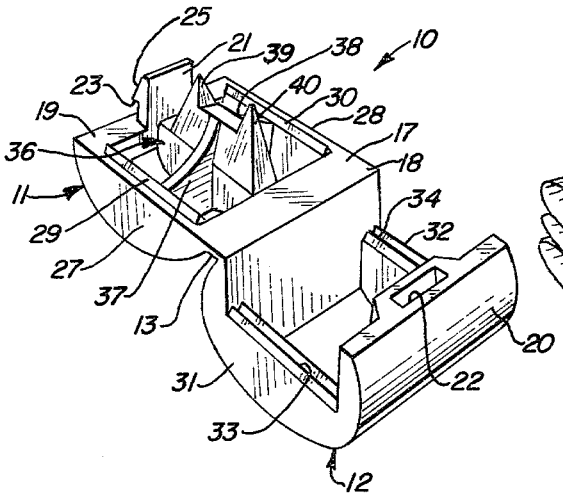
FIG. 2
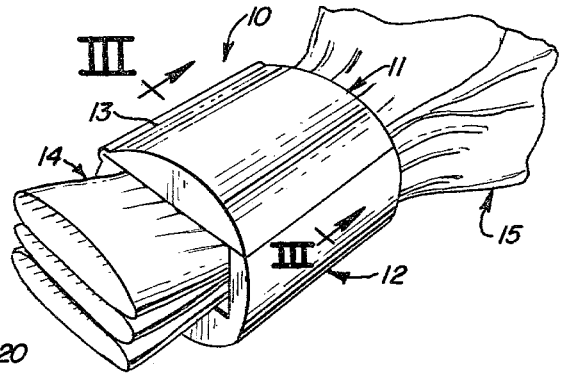
FIG. 3
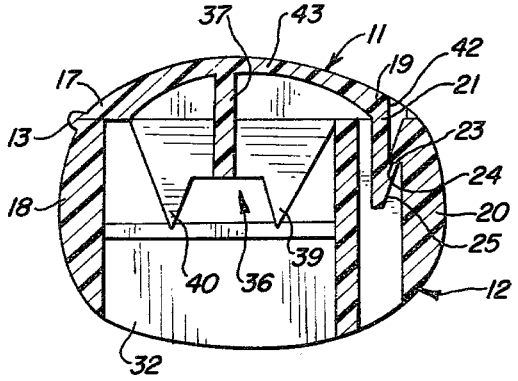
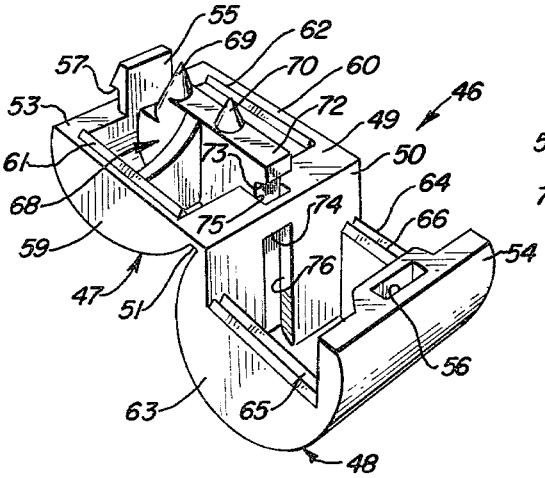
FIG. 4
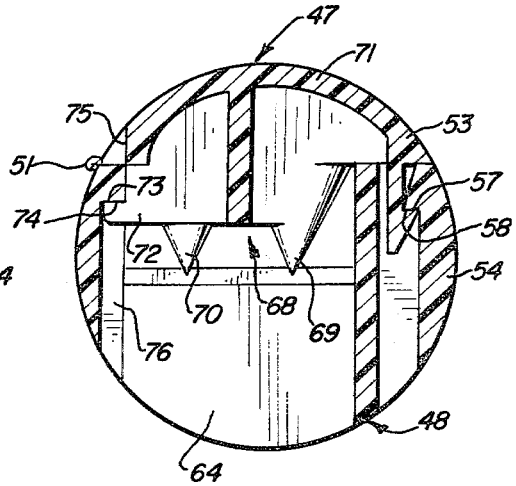
FIG. 5

FIG. 6
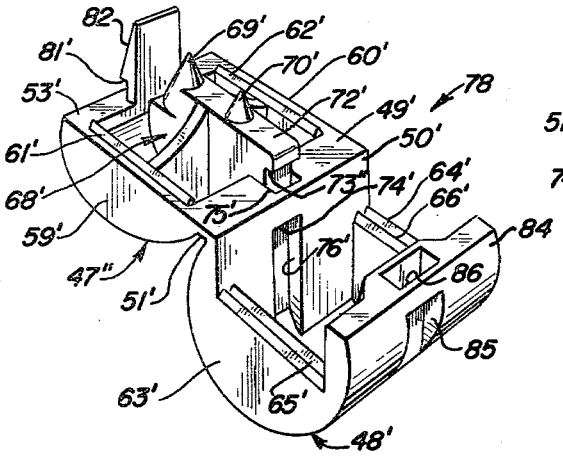
FIG. 7
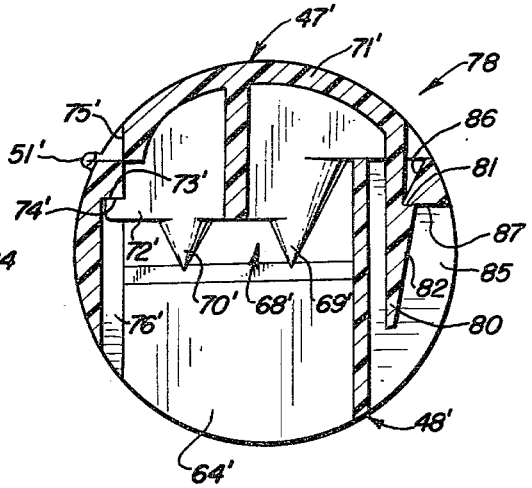
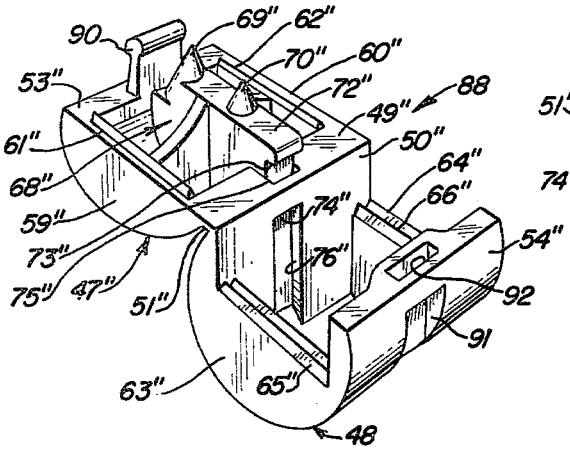
FIG. 8
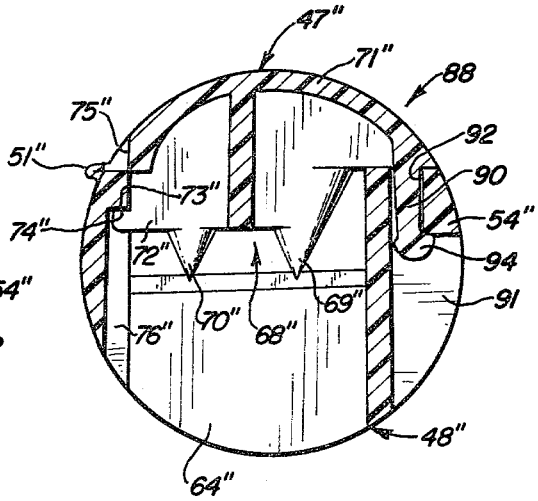
FIG. 9

SEALING DEVICES

This invention relates to sealing devices and more particularly to sealing devices for engaging gathered-together material at an end of an enclosure such as a plastic bag or a sausage casing. The devices of this invention are easily installed and are highly reliable while being readily and economically manufacturable.

BACKGROUND OF THE INVENTION

In my U.S. Pat. No. 4,128,922, issued Dec. 12, 1978, I disclose a sealing device arranged to provide an effective and reliable seal at the end of an enclosure such as a plastic bag or sausage casing. The device as disclosed in my patent avoids problems encountered with prior devices, and includes first and second members adapted to receive therebetween gathered-together material at the end of an enclosure. Such members are preferably of a plastic or other non-metallic material so as to avoid problems encountered with metal staples or clips. Locking means are provided for attaching the members together and one of the members has a projecting central portion guided within an opening in the other member, for engagement with the gathered-together material to provide a seal. Additional seals are provided by means of registering transverse projections and recesses on end portions of the two members. In addition, means are provided for guiding the locking elements and other interacting portions of the members into proper registering relationship.

There are many other disclosures of sealing devices designed for a wide variety of purposes and having many different constructions. In some devices, resilient clips are provided including portions resiliently movable apart to receive a portion of a bag or other enclosure therebetween. In others, the devices have been arranged to be deformed to clamp portions of a bag or the like between portions of the devices.

Such prior art devices, while being satisfactory for some purposes, have not been as efficient or reliable as the device disclosed in my aforementioned patent. Also, the prior art does not recognize any problems with the device as disclosed in my patent or suggest the possibility of improvements thereon.

SUMMARY OF THE INVENTION

This invention was evolved with the general object of improving upon the device of my patent and in making further improvements over prior art devices.

One aspect of the invention resides in the recognition of a problem which can be encountered with a device such as disclosed in my patent in that it takes a certain amount of time to place the two members of the device into registering relationship. In accordance with this invention, a device is provided which includes the simple expedient of providing a hinge between side portions of two members, allowing movement of the members between an open condition in which gathered-together material is receivable therebetween and a closed condition in which such material is clamped therebetween. Locking means are provided for holding the members in the closed condition and, preferably, one of the members has a central projecting portion arranged to move into an opening of the other member to carry portions of the material into such an opening and to provide a seal. A simple hinge connection is highly advantageous in this arrangement because it automatically aligns the locking means as well as the projecting portion of the first member and the opening of the second member which coact therewith.

The alignment feature obtained with the hinged connection is especially advantageous when the device is to be automatically closed through the use of machines in that it reduces the required number and complexity of machines required for this purpose.

The devices of this invention further include transversely extending ridges on end portions of one member adapted to align with grooves on end portions of the other member to provide a frictional gripping action on longitudinally spaced portions of the gathered-together material and also to provide an improved seal. The hinge arrangement is further advantageous in combination with this feature in that it facilitates accurate alignment of the grooves and recesses.

The members are preferably made of a plastic material and the hinge means is preferably in the form of a thin element of plastic material which is formed integrally with the two members. With this feature, the device can be formed in a single molding operation.

Another specific feature of the invention relates to the provision of at least one sharp spear portion on the central projecting portion of one member for penetrating layers of the gathered-together material and to prevent longitudinal movement of the material relative to the device. As a result, a more effective and reliable seal is attained. Preferably, a pair of spears are provided which are transversely spaced.

Additional important features relate to the construction of the locking means. In one type of arrangement, the two members have side portions which have interengaging shoulders, at least one of the members being resiliently deformable with a beveled surface being provided to limit movement until the shoulders can interengage in a locked position. In one construction using this type of arrangement, the members cannot be released from the locked condition. In another construction, release of the members can be obtained through the use of a portion of one member which is resiliently deflectable to move the shoulders out of alignment. In both constructions, a lock is provided which is permanent at least until such time as a release is desired.

In another arrangement, an even more permanent attachment is obtained by welding two portions of the members together after they moved to the closed condition.

Additional important features relate to details of construction of the locking, sealing and other elements to obtain highly reliable operation while facilitating manufacture, installation and use of the devices.

This invention contemplates other objects, features and advantages which will become more fully apparent from the following detailed description taken in conjunction with the accompanying drawings.

BRIEF DESCRIPTION OF THE DRAWINGS

FIG. 1 is a perspective view of a sealing device constructed in accordance with the invention, shown in an open condition;

FIG. 2 is a perspective view showing the device of FIG. 1 in a closed condition in clamping relationship to gathered-together material at the end of an enclosure;

FIG. 3 is a sectional view taken substantially along line III—III of FIG. 2;

FIG. 4 is a perspective view of a modified sealing device constructed in accordance with the invention, shown in an open condition;

FIG. 5 is a sectional view of the device of FIG. 4, similar to FIG. 3 and showing the relationship of the parts in the closed condition of the device;

FIG. 6 is a perspective view of another modified sealing device constructed in accordance with the invention, shown in an open condition;

FIG. 7 is a sectional view of the device of FIG. 6, similar to FIGS. 3 and 5 and showing the relationship of the parts in a closed condition of the device;

FIG. 8 is a perspective view of a further modified device constructed in accordance with the invention; and FIG. 9 is a sectional view of the device of FIG. 8, similar to FIGS. 3, 5 and 7 and showing the relationship of the parts in a closed condition of the device.

DESCRIPTION OF PREFERRED EMBODIMENTS

Reference numeral 10 generally designates a sealing device constructed in accordance with the principles of the invention. The device 10 is designed for use in engaging gathered-together material at the end of an enclosure such as a plastic bag or sausage casing, to seal the enclosure. The device 10 comprises a pair of closure members 11 and 12 which are connected by a hinge 13. In the illustrated construction, the hinge 13 is in the form of a thin strip of plastic formed integrally with the members 11 and 12 which are also of plastic. The device 10 is arranged to receive gathered-together material 14 at the end of an enclosure 15 when the device is in an open condition as shown in FIG. 1 and the closure member 11 may then be pivoted to a closed position as shown in FIG. 2 to clamp the material 14 between the members 11 and 12.

The members 11 and 12 have first side portions 17 and 18 which are interconnected by the hinge 13 and they have opposite second side portions 19 and 20 which are interengaged in the closed condition of FIGS. 2 and 3. The side portion 19 of the member 11 carries a projection 21 which is movable into a recess 22 in the side portion 20 of member 12 in the closed condition. Projection 21 has a shoulder 23 which, in the closed condition, engages a shoulder 24 within the side portion 20, the projection 21 being resiliently deformable to allow movement to the closed condition to move with a snap action to the position in which the shoulders 23 and 24 are interengaged. In the illustrated arrangement, the projection 21 has a beveled surface 25 for cammingly engaging a surface of the side portion 20 during movement of the members to the closed condition, effecting the resilient deformation of the projection 21 which is required to reach the position in which the shoulders 23 and 24 may engage.

The member 11 has end portions 27 and 28 which have transversely extending ridges 29 and 30 formed thereon while the member 12 has end portions 31 and 32 formed with grooves 33 and 34, the ridges 29 and 30 being aligned with the grooves 33 and 34 when the device is in the closed condition thereof. Preferably, the ridges 29 and 30 and pairs of ridges which define the grooves 33 and 34 are of generally V-shaped configuration and they serve to frictionally engage longitudinally spaced portions of the gathered-together material with a clamping action to resist longitudinal movement and to provide seals.

The member 11 is formed with a central projecting structure 36 which preferably extends from the side portion 17 to the side portion 19 with additional supporting portions 37 and 38 extending from the structure 36 to the end portions 27 and 28. The central projecting structure 36 engages the gathered-together material to provide an additional seal, the structure 36 having a dimension such as to stretch the gathered-together material and to further enhance the sealing action.

Preferably, the projecting structure 36 is formed with at least one sharp pointed spear end for piercing the gathered-together material, the illustrated structure 36 having two transversely spaced spear ends 39 and 40 as illustrated.

With the construction as illustrated, the hinge 13 accurately establishes the relative positions of the members 11 and 12 so that the projection 21 will accurately align with the recess 22, so that the ridges 29 and 30 will accurately align with the grooves 33 and 34 and so that the central projecting structure 36 will be accurately positioned in the center of the open space into which it moves in the closed condition of the device. As a result, reliable operation of the locking and sealing elements is insured. The hinge arrangement is also advantageous in that it reduces the number of machines required to apply a closure to a casing or bag to half the number which would be necessary to apply a two-piece closure. In addition, it reduces the complexity of machines required to apply closures, by eliminating the alignment requirements of two-piece closure designs.

The use of the pointed sharp spears 39 and 40 is an important feature in that they can penetrate several folded layers of material between the meshing redges 29, 30 and grooves 33, 34, preventing the material from being pulled longitudinaly through the device in response to pressure applied when filling, processing and handling the product in the casing or bag 15.

The construction of the device 10 as illustrated is also advantageous in that it can be readily formed from plastic in a single molding operation. It is noted, in this connection, that the space in the side portion 20 which is below the shoulder 24, in the position of the device as illustrated, is open so that the shoulder 24 may be formed in a one-shot molding operation. Also, the side portion 19 of the member 11 may be formed with an opening 42 opposite the shoulder 23 of the projection 21, permitting formation of the shoulder 23 in a one-shot molding operation.

The member 21 may be provided with a wall 43 which forms a top wall for the device in the closed condition thereof, on which suitable indicia may be formed or on which a suitable label may be secured, as desired. The member 12 is open in the illustrated construction, but might be formed with a closed wall, if desired.

FIGS. 4 and 5 illustrate a modified device generally designated by reference numeral 46. The device 46 is similar to the device 10 and includes a pair of members 47 and 48 which have first side portions 49 and 50 interconnected by a hinge 51 and having second side portions 53 and 54. The side portion 53 carries a projection 55 which is movable into a recess 56 in the side portion 54, the projection 55 having a shoulder 57 engageable with a shoulder 58 of the wall portion 54 in the closed condition of the device. The member 47 has end portions 59 and 60 which have transversely extending ridges 61 and 62 thereon while the member 48 has end portions 63 and 64 formed with grooves 65 and 66. The member 47 is also formed with a central projecting structure 68 which extends from the side portion 49 to the side portion 53 and which carries a pair of pointed spears 69 and 70. In addition, member 47 has a wall 71 which forms a top wall in the closed condition as illustrated in FIG. 5.

As thus far described, the device 46 is like the device 10 and functions in a similar manner differing therefrom in that it has a generally cylindrical overall shape and in that the spears 69 and 70 are conical rather than pyramidal in shape. Another difference is that the central projecting structure 68 is formed with a portion 72 which projects to a plane which is aligned with the axis of relative hinging movement of the members 47 and 48. The projecting portion 72 has a shoulder 73 which faces the plane of the surface of the side portion 49 engaged with the surface of the side portion 50 in the closed condition of the device. In the closed condition of the device, as shown in FIG. 5, the shoulder 73 engages a shoulder 74 formed in the side portion 50 of the member 48. With the shoulders 73 and 74 in engagement in the closed condition of the device, a more secure lock is provided, the hinge 53 being effectively reinforced. Thus, once the device is in the closed condition, it would remain closed even if the hinge 51 completely failed.

To facilitate molding, the side portion 49 may be formed with an opening 75 opposite the shoulder 73. Also, the side portion 50 of the member 48 may be formed with an open channel 76 opposite the shoulder 74.

FIGS. 6 and 7 illustrate another modified device generally designated by reference numeral 78. The device 78 has a construction which is very similar to that of the device 46 of FIGS. 4 and 5, primed numbers being used to designate parts having the same construction. In the device 78, a modified projection 80 is provided in place of the projection 55 of the device 46, the projection 80 having a shoulder 81 and also having a beveled surface 82, but is different in that it has a longer length so that the surface 82 has a large area for engagement for release purposes. The device 78 also has a modified side portion 84 having a construction differing from the side portion 54 of the device 46 in that an open space 85 is provided at the lower end of a recess 86 which receives the projection 80, permitting access to the projection 80 in the closed condition of the device. The shoulder 81 of the projection 80 engages a shoulder 87 in a closed condition and when pressure is applied to the surface 82 in the closed condition, the shoulder 81 is moved out of engagement with the shoulder 87 to release the device from its locked condition. Preferably, the surface 82 may be provided with suitable indicia to indicate that it is for release purposes such as, for example, "Push to Release".

FIGS. 8 and 9 illustrate another modified device which is generally designated by reference numeral 88. The device 88 is similar to the device 46 and corresponding parts are designated by double primed numbers. In the device 88 the side portion 53'' carries a projection 90 which is unlike the projection 55 in that it has no shoulder thereon. The member 48'' of the device 88 has a modified construction in that it has an open space 91 at the lower end of the opening 92 which receives the projection 90 in the closed condition of the device. When the device is closed, a suitable tool may be used to apply heat to the terminal end of the projection 90 to form a bead 94 thereon and to more permanently lock the device against being opened.

Each of the devices as disclosed has the advantageous one piece construction and the advantageous hinge connection which make it possible to more readily and economically mold the device. They also make it easier to handle and make it possible to more quickly engage the device with gathered-together material at the end of a bag or casing enclosure while insuring accurate alignment of the central projecting structure of one member with an opening in the other and alignment of the locking and sealing means of the devices. In each of the disclosed devices, the pointed spears are provided which are advantageous in securing some types of material within the device although not being essential to its operation and need not be provided in all cases. It is also noted that the devices of FIGS. 4–9 have generally cylindrical shapes to be more or less in the shape of a barrel whereas the device of FIGS. 1–3 has more of a clam shell shape. The clam shell shape is advantageous in that identification and/or advertising material can be more easily placed thereon but the barrel shape may be used if desired.

It will be understood that modifications and variations may be effected without departing from the spirit and scope of the novel concepts of this invention.

What is claimed is:

1. A sealing device for engaging gathered together material at an end of a bag or casing enclosure, comprising: first and second closure members each having first and second opposite side portions and first and second end portions, hinge means connecting said first side portions of said first and said closure members for relative pivotal movement about a hinge axis between an open condition in which gathered-together material is received therebetween and a closed condition in which the gathered-together material is clamped therebetween, and interengageable locking means for holding said members in said closed condition, said first member having a central projecting portion between said first and second end portions thereof and said second member having an opening between said first and second end portions thereof for receiving said central projecting portion and the gathered-together material engaged by said central projecting portion, said hinge means being operable to guide said locking means into registering engagement and being also operative to guide said central projecting portion of said first member into registering relationship with respect to said opening in said second member.

2. In a sealing device as defined in claim 1, end engagement means on said first and second end portions of said first and second closure members for frictional engagement with longitudinally spaced portions of the gathered-together material.

3. In a device as defined in claim 2, said end engagement means including means defining narrow transversely extending ridges on one of said closure members and transversely extending recesses for movement on the other of said members in registry with said ridges in said closed condition of said members.

4. In a device as defined in claim 1, said central projecting portion including at least one pointed spear end for piercing the gathered-together material.

5. In a device as defined in claim 4, said central projecting portion including a pair of transversely spaced pointed spear ends for piercing transversely spaced portions of the gathered-together material.

6. In a sealing device as defined in claim 1, said first and second closure members having shoulder surfaces engageable in said closed condition of said members in a plane which is in approximate alignment with said hinge axis, to prevent movement toward said open condition, said shoulder surfaces forming part of said interengageable locking means.

7. In a sealing device as defined in claim 6, said shoulder surfaces being located on said first side portions of said closure members.

8. In a sealing device as defined in claim 6, said shoulder surfaces being lcoated on said second side portions of said members, the portion of at least one of said second side portions adjacent said shoulder surface thereof being subject to resilient deformation to allow said shoulder surface thereof to move past the other shoulder surface and to snap back to a position in engagement with the other shoulder surface in said closed condition, and said second side portions of said members having interengageable surfaces for camming engagement to effect said resilient deformation during movement to said closed condition.

9. In a sealing device as defined in claim 8, manual release means for effecting said resilient deformation of said one of said members to allow movement from said closed condition to said open condition.

10. In a sealing device as defined in claim 8, one of said second side portions having a projection therefrom and the other of said second side portions having a recess receiving said projection in said closed condition of said members, said projection having one of said shoulder surfaces thereon and the other of said shoulder surfaces being adjacent said recess, said projection being subject to said resilient deformation for allowing engagement of said shoulder surfaces.

11. In a sealing device as defined in claim 10, said projection being substantially inaccessible in said closed condition to prevent release of the members from said closed condition.

12. In a sealing device as defined in claim 10, said projection having a terminal end portion accessible in said closed condition for manual movement to release said members from said closed condition.

13. In a sealing device as defined in claim 1, said first and second closure members having interengageable portions adapted to be welded together in said closed condition.

14. In a sealing device as defined in claim 13, one of said second side portions having a projection therefrom and the other of said second side portions having a recess for receiving said projection in said closed condition, a terminal end portion of said projection being arranged to be welded to said other of said second side portions to secure said members together in said closed condition.

15. In a sealing device as defined in claim 1, said first and second closure members and said locking and hinge means being formed of a moldable plastic material and having forms such as to permit simultaneous molding thereof in a one-shot molding operation.

16. In a sealing device as defined in claim 6, said first and second closure members and said locking and hinge means being formed of a moldable plastic material, said first and second closure members having openings opposite said shoulder surfaces and said closure members and said locking end hinge means being otherwise so formed as to permit simultaneous molding thereof in a one-shot molding operation.

17. In a sealing device as defined in claim 1, said hinge and locking means and said first closure member cooperating in said closed condition to restrain limit movement of said first and second opposite side portions of said second closure member away from each other and to thereby prevent release of said locking means.

18. In a sealing device as defined in claim 17, said locking means including an interfitting projection and pocket means on said second side portions of said first and second closure members, said projection and pocket means extending generally transversely with respect to a radial plane through the axis of said hinge means.

* * * * *